United States Patent [19]

Gramling

[11] 4,089,242

[45] May 16, 1978

[54] METHOD AND APPARATUS FOR FORMING GASKETS AND THE LIKE

[76] Inventor: James T. Gramling, 10312 W. 48th Ter., Shawnee, Kans. 66203

[21] Appl. No.: 642,766

[22] Filed: Dec. 22, 1975

[51] Int. Cl.[2] ..... B26D 7/06

[52] U.S. Cl. ..... 83/95; 83/69; 83/55; 83/91

[58] Field of Search ..... 83/78, 86, 89, 69, 95, 83/91, 55

[56] References Cited

U.S. PATENT DOCUMENTS

| | | | |
|---|---|---|---|
| 2,281,439 | 4/1942 | Heftler | 83/95 |
| 2,587,214 | 2/1952 | Polk | 83/69 |
| 2,857,968 | 10/1958 | Cousino | 83/69 |
| 3,263,882 | 8/1966 | Nugent et al. | 83/95 |

*Primary Examiner*—Donald R. Schran

[57] ABSTRACT

A machine which cuts gaskets and similar parts from a thin strip of material and which arranges the parts in stacks. Feed rollers periodically advance the gasket material through a pair of dies which are forced together by a hydraulic ram. The cut gaskets are carried with the strip to a knockout station at which pneumatic cylinders force knockout dies against the gaskets to separate them from the strip. The gaskets fall onto a rack on which they are stacked until a preselected number is contained in the stack, at which time the machine stops. Power cylinders then extend the rack to a position where the stacked gaskets are readily accessible for removal.

14 Claims, 14 Drawing Figures

Fig. 4.
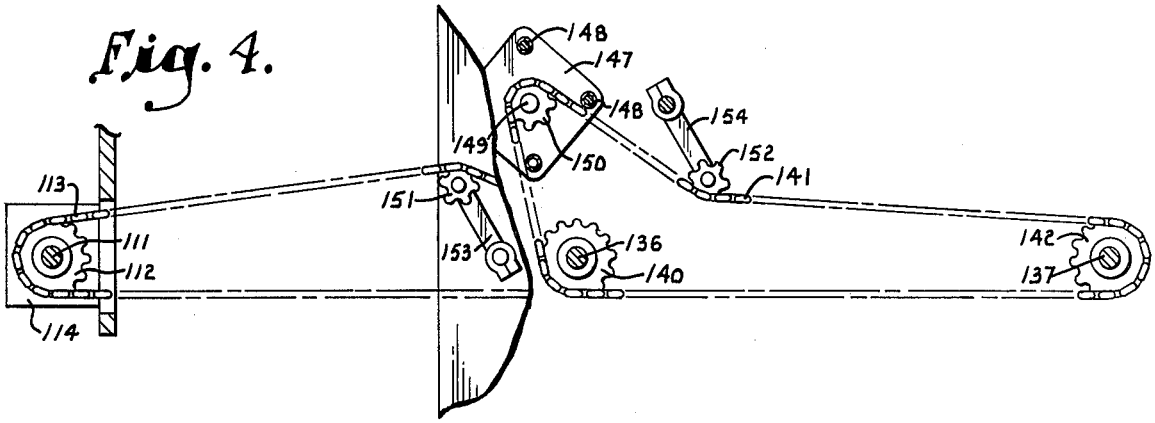
Fig. 5.
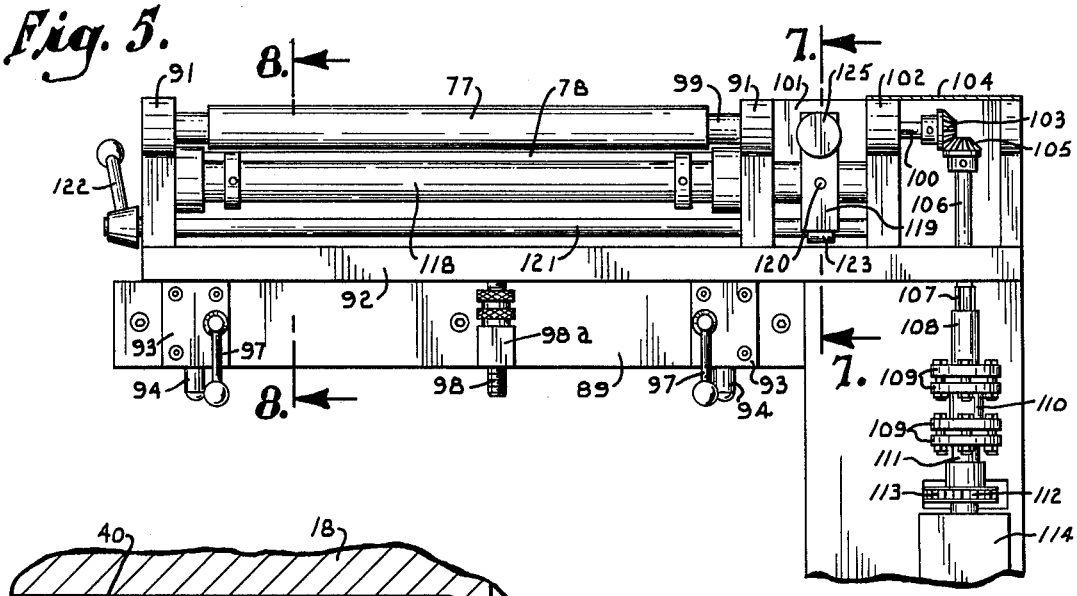
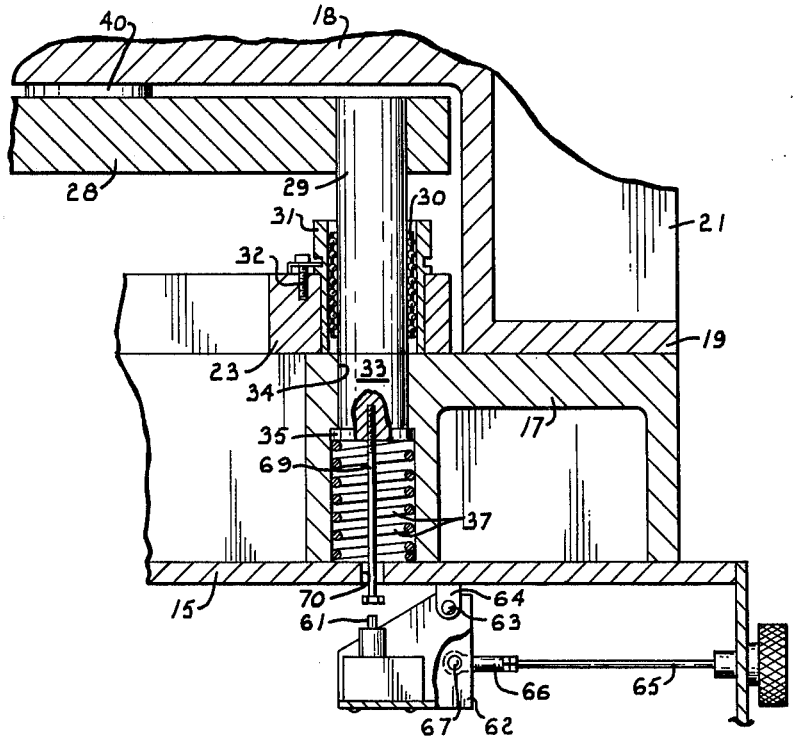
Fig. 6.

METHOD AND APPARATUS FOR FORMING GASKETS AND THE LIKE

BACKGROUND AND SUMMARY OF THE INVENTION

This invention relates generally to the production of gaskets and similar parts and deals more specifically with a machine for forming and handling such parts.

The mass production of gaskets and similar thin parts is carried out by a die cutting process employing usually one of two types of cutting apparatus. One is a steel rule cutting tool having a knife edge and which is reciprocated against the gasket material on a first support surface to cut the gaskets; the other is a punching assembly which consists of interfitting male and female dies, one of which may be reciprocated against the other to cut the gasket material at the mating edges of the dies. Either of the foregoing cutting devices are presently used in large, open back, inclined mechanical presses which were originally developed for stamping parts out of relatively thick sheets of metal and printing presses especially adapted for manufacturing gaskets. Since gaskets and similar parts are formed from cork, rubber, foam, asbestos, and other materials that are soft in comparison to thick metal sheets, these metal forming machines have not been particularly successful in efficiently forming gaskets.

A major drawback has been the slowness with which existing machines operate. Cranks are typically provided in this type of equipment to effect a power stroke that is fixed in length. The stroke is usually between 4 and 6 inches which is unnecessarily long for cutting gaskets from relatively soft material, and the speed at which the machine operates is restricted accordingly. The excessively long power stroke in combination with the inherently slow operation of the crank mechanism limits the conventional punch press to an operating speed that is usually less than 80 strokes per minute. In addition, the force of the stroke in these machines typically ranges from 10 to 100 tons which is considerably more powerful than is needed to cut soft gasket material. Therefore, the cutting dies and other working components of the machine wear out relatively quickly.

Existing equipment is further unsatisfactory due to its inability to cut with the precision that is required for gaskets and like parts. This problem is compounded because of the tendency of the cutting dies to quickly become dull and worn, as previously indicated. In the case of the steel rule die, uniformly accurate cutting of the gasket material is also difficult to achieve because the ram which performs the cutting stroke is often misaligned with respect to the striker plate against which it acts. Shims are frequently used in an effort to maintain the striker plate oriented properly to the ram, and the accuracy resulting from this arrangement falls far short of that required for precision cutting of gaskets.

In most cases the gasket material is fed through existing machines by hand. This of course further detracts from the operating speed and also results in the waste of a substantial amount of material. Despite the skill or experience of the machine operator, the strip material cannot be manually fed in a manner to cut successive gaskets as closely together as possible in order to minimize the scrap. The manual feeding procedure is also unsatisfactory from a safety standpoint because the hands of the machine operator must be placed near the cutting die in order to pull the material through the machine by hand. Even those machines that are equipped with mechanical feed mechanisms require excessive time to set up so that it is impractical to utilize the mechanical feed unless a large number of parts are to be run. These existing feed devices are also unable to advance the gasket material in accurate length increments at high rates of speed and are costly to construct and maintain.

The handling of the gaskets after they have been cut has been an additional problem that has substantially increased the production time and the labor costs. The gaskets are usually removed by hand from the strip of material from which they are cut. This involved the knocking out of the gaskets and slug material, disposal of the scrap, counting of the gaskets, and the arranging of the gaskets in stacks, all of which is normally done by hand.

In view of the aforementioned difficulties associated with existing gasket producing equipment, there is a need for an improved machine that is able to efficiently and economically form gaskets and similar parts. It is the primary goal of the present invention to meet that need.

More specifically, it is an important object of the present invention to provide a machine that operates to cut gaskets and similar parts with increased precision as compared to existing equipment.

Another important object of the present invention is to provide a machine of the character described that operates at a high rate of speed in order to minimize the production time.

Still another object of the invention is to provide a machine of the character described that includes means for accurately adjusting the length and pressure of the power stroke that effects cutting of the gaskets. Adjustment of the stroke length to the minimum travel maximizes the speed at which the machine can operate, while setting the pressure of the stroke as small as possible decreases the wear on the cutting dies and tools and thus increases their useful life.

A further object of the invention is to provide a machine of the character described wherein the cutting dies remain parallel at all times, thereby assuring uniformly accurate cutting of the parts and adding to the life of the dies and tools.

An additional object of the invention is to provide a machine of the character described that is equipped with an automatic feed mechanism which advances the gasket material in accurately controlled length increments. This close control of the length of feed maximizes the number of parts that are formed from the material and permits the knocking out and stacking of the parts to be accurately carried out.

Yet another object of the invention is to provide a machine of the character described wherein the feed mechanism is able to receive and advance even short strips of material without detracting significantly from its operating speed.

A still further object of the invention is to provide a machine of the character described in which the feed mechanism may be quickly and easily set up for operation.

An additional object of the invention is to provide a machine of the character described that includes means for counting the parts that are formed and for arranging them in stacks containing a preselected number.

Another object of the invention is to provide a machine of the character described that is adapted to utilize cutting die sets of various sizes and shapes which may be easily installed and removed.

A further object of the invention is to provide a machine of the character described which operates with low power requirements.

Still another object of the invention is to provide a machine of the character described that is economical to construct and maintain.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views:

FIG. 4 is a fragmentary plan view of the drive linkage on an enlarged scale taken generally along line 4—4 of FIG. 3 in the direction of the arrows;

FIG. 5 is an enlarged, fragmentary end view of a drive roller assembly taken generally along line 5—5 of FIG. 3 in the direction of the arrows;

FIG. 6 is a fragmentary sectional view of the die set on an enlarged scale taken generally along line 6—6 of FIG. 3 in the direction of the arrows;

Figure 1:
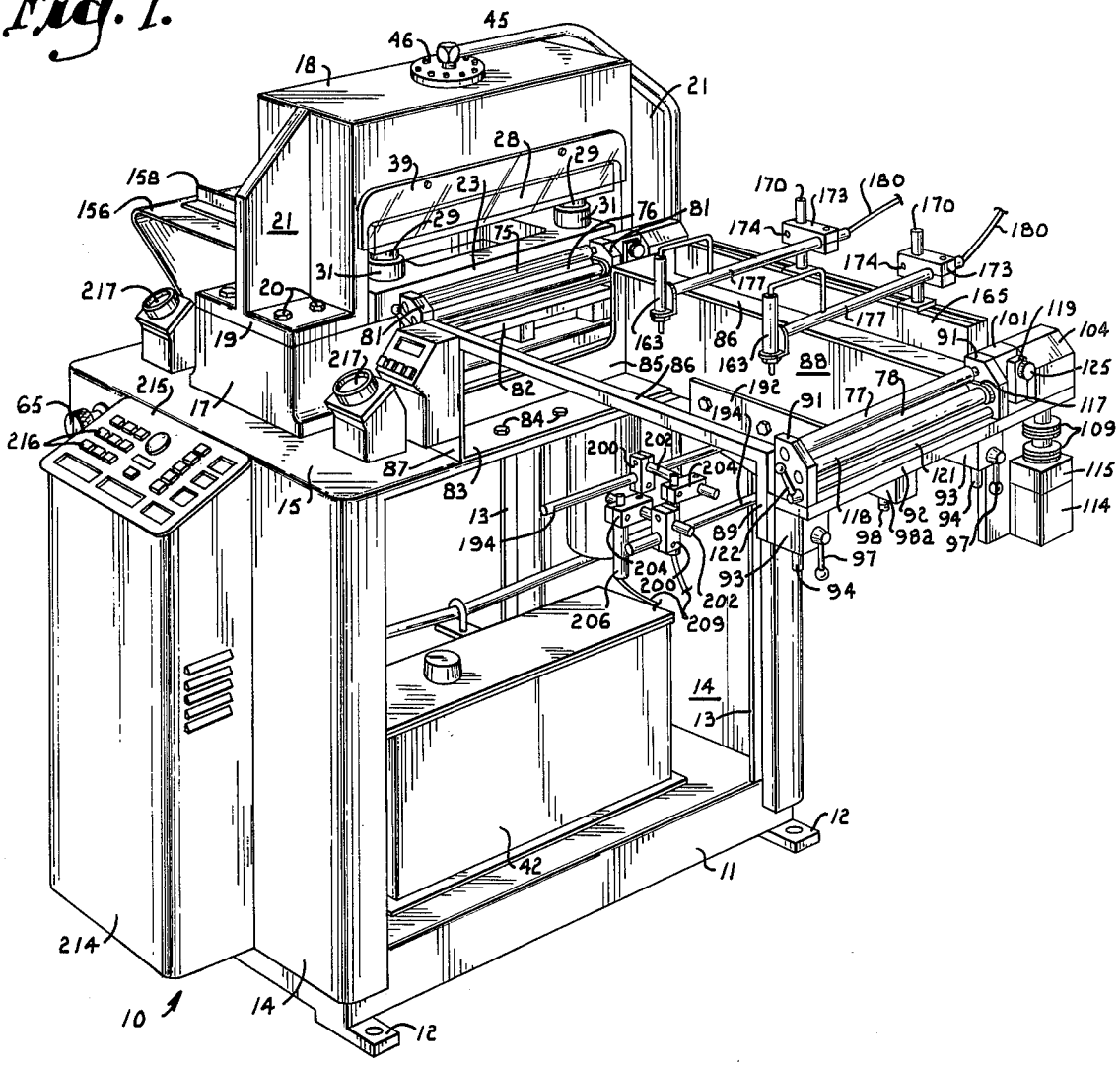
FIG. 1 is a perspective view illustrating a gasket forming machine constructed in accordance with a preferred embodiment of the invention.
Figure 3:
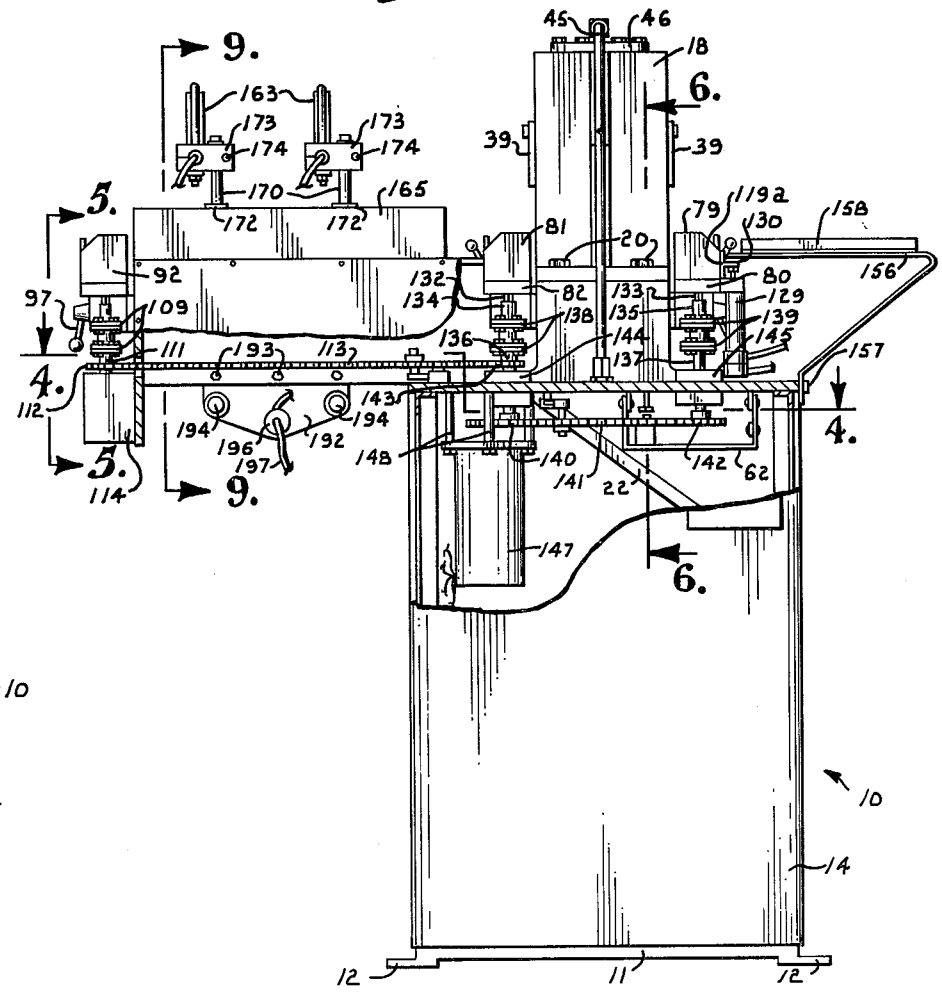
FIG. 3 is a rear elevational view of the machine shown in FIG. 1 with portions broken away to illustrate the internal details.
Figure 2:
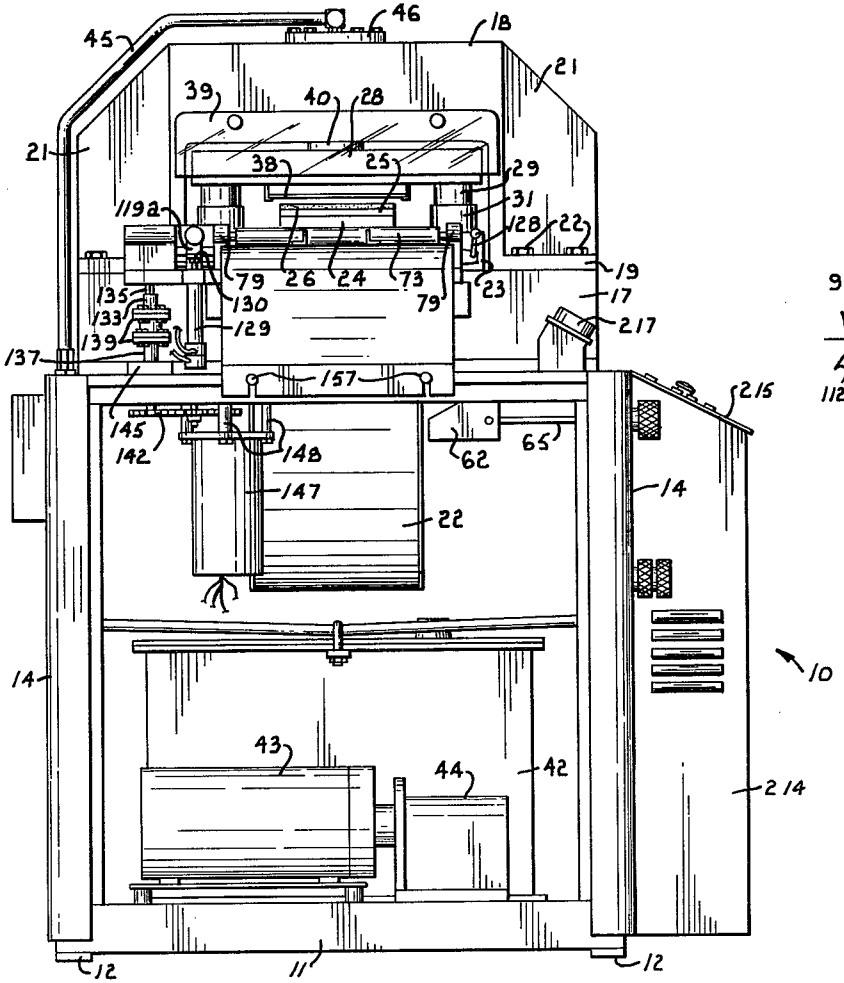
FIG. 2 is a side elevational view of the machine taken from the left hand side of FIG. 1.

Referring now to the drawings in detail and initially to FIGS. 1-3, reference numeral 10 generally designates a machine for forming gaskets and other parts. The frame of the machine includes a base portion 11 from which apertured lugs 12 project to permit the machine to be bolted to the floor. Upright corner posts 13 extend upwardly from each corner of base 11, and side panels 14 are fit between posts 13 over the sides of the machine. End panels (not shown) normally cover the ends of the frame in similar fashion. A horizontal top plate 15 fits over the top of the frame and supports the working components of the machine.

A press type cutting assembly that cuts gaskets from thin strips of material includes a base block 17 which is secured to the top side of plate 15 to form the bed of the press. The upper frame of the cutting press includes a generally inverted U-shaped block 18. Horizontal flanges 19 are formed on the opposite lower ends of block 18 and are bolted at 20 to the top of block 17 to secure the two blocks together, with the lower surface of block 18 spaced well above the upper surface of block 17. Vertical ribs 21 extend between flanges 19 and block 18 for reinforcement. The central portion of block 17 is cut out in order to receive slug material that is sometimes blanked out in the cutting press. A chute 22 (FIG. 3) is mounted at an inclined angle to the underside of plate 15 to receive the slug material.

A die set is installed in the area between blocks 17 and 18. The die set includes a flat lower die 23 which is bolted to the upper surface of block 17. As shown in FIG. 2, a metal plate 24 is bolted to the top of die 23, and a wooden block 25 is secured to the top of plate 24. A steel rule cutting tool (not shown) is embedded in block 25, and this tool has sharp cutting blades that project above the block. The cutting blades are arranged and shaped in the outline of the gaskets to be cut. A pad 26 constructed of sponge rubber or the like is secured on top of block 25 to normally shield the blades of the cutting tool. Pad 26 may be deformed or squeezed downwardly to permit cutting by the tool. Immediately after completion of the cutting, the resiliency of pad 26 returns it upwardly and thereby raises the gasket material off of the cutting blades.

An upper die 28 is supported above the lower die 23 for up and down movement. Four pins 29 are secured to die 28 near the corners thereof. As best shown in FIG. 6, each pin 29 projects well below die 28 and is received in a ball bushing 30 that is fit within a sleeve 31. Each sleeve 31 is received in a bore in the lower die 23 and is secured therein by a screw 32. The lower end of each pin 29 is normally flush with the lower surface of die 23 where it engages a short pin 33 that slides in a vertical bore 34 formed through block 17. Each bore 34 is of stepped configuration, and each pin 33 includes an enlarged flange 35 on its lower end which engages the shoulder formed at the stepped bore portion to limit upward movement of the pin.

A compression spring 37 is fit in the lower portion of each bore 34 to act upwardly against flange 35, the lower end of each spring bearing against plate 15. Springs 37 act through pins 33 and 29 to urge the upper die 28 upwardly at all times toward the position shown in FIG. 6. It is noted that the pins 29 maintain the upper die 28 parallel with the lower die 23 and thus provide accurate guiding of the dies that prevent the gasket material from being engaged in an uneven manner by the cutting tool. A metal striker plate 38 (FIG. 2) is bolted to the lower surface of die 28 to move against the blade of the cutting tool when the upper die is pressed downwardly.

Each die set may be easily removed by unbolting the lower die 23 and sliding the entire die set out from between blocks 17 and 18. Alternatively, the striker plate 38 may be unbolted from the upper die, and plate 24 along with the associated parts may be removed from the lower die in order to change cutting tools. Of course, the sets of dies may have the cutting tool mounted to the upper die 28 instead of to the lower die 23 as illustrated in the drawings. Removable guards 39 are secured to cover part of each side of the cutting press.

A hydraulic ram 40 (FIG. 2) acts against the upper die 28 to force the same downwardly toward die 23 in order to cut the gasket material. As indicated schematically in FIG. 13, ram 40 fits slidably in a cylinder 41 that extends vertically through block 18. Ram 40 is a single acting ram which is forced downwardly by hydraulic fluid but which is returned upwardly by springs 37. With reference again to FIG. 2, a hydraulic fluid tank 42 is mounted on base 11. A motor 43 drives a pump 44 which pumps fluid from tank 42 and into cylinder 41 through a hydraulic line 45 that extends through a cap 46 which is fit over the top of the cylinder.

Figure 13:
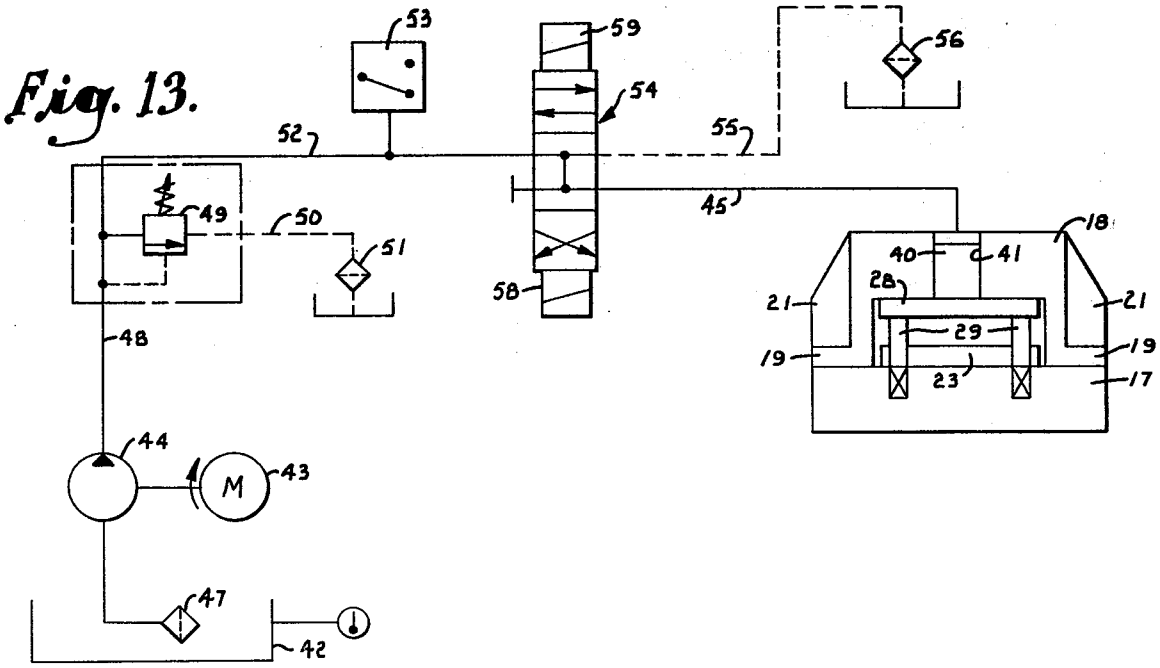
FIG. 13 is a schematic view illustrating the hydraulic system of the machine.

The hydraulic system which controls the operation of ram 40 is illustrated schematically in FIG. 13. The fluid that is pumped out of tank 42 by the pump 44 passes through a filter 47 and a fluid line 48 which leads to a manually adjustable pressure relief valve 49 that prevents overloading of the hydraulic system. When the hydraulic pressure exceeds the pressure level at which valve 49 is set, the valve directs the fluid back to the fluid reservoir through a return line 50 in which a filter 51 is disposed. The fluid that passes on through valve 49 enters a fluid line 52 which leads to a pressure transducer 53. Line 52 extends onto a spool type directional control valve 54. Line 45 leads from valve 54 to cylinder 41, while a return line 55 equipped with a filter 56 extends from valve 54 back to the fluid reservoir.

The directional control valve 54 is operated by a pair of solenoids 58 and 59 which drive the valve in opposite directions. Valve 54 is a spool type valve which has three positions. With both solenoids 58 and 59 deenergized, a spring (not shown) maintains valve 54 in a centered position wherein fluid is directed from cylinder 41 back to the fluid reservoir, and ram 40 is therefore raised by springs 37 when the valve is centered. When solenoid 58 is energized, fluid is directed through valve 54 to cylinder 41 to thereby cause extension of ram 40.

There are two different mechanisms provided to deenergize solenoid 58 and thus stop the power stroke of ram 40. In cases where gaskets are to be cut but not knocked out of the strip of material in the cutting press the pressure transducer 53 serves to deenergize solenoid 58 to stop the downward stroke of the ram. The pressure transducer senses the fluid pressure and generates a voltage that is proportional to that pressure. This voltage is fed to a solid state comparator (not shown) which compares it with a preset reference voltage. When the two voltage levels are equal, an output signal is generated which turns off solenoid 58.

Alternatively, if the gaskets are to be blanked out in the cutting press, solenoid 58 may be deenergized by means of a plunger type limit switch 61 that is illustrated in FIG. 6. The limit switch 61 is mounted on a bracket 62 which is pinned at 63 to an ear plate 64 that extends below plate 15. Switch 61 is vertically adjustable by means of an elongate thumb screw 65 that is threaded into a small sleeve 66 which is pinned at 67 to bracket 62. The head of screw 65 is accessible for turning in order to move switch 61 up or down.

A vertical pin 69 which operates limit switch 61 is threaded into the bottom end of pin 63. Pin 69 projects downwardly through a hole 70 in plate 15 and is provided with an enlarged lower end which engages switch 61 upon adequate downward movement of ram 40. Depression of switch 61 deenergizes solenoid 58 to permit springs 37 to raise the ram.

Pressure transducer 53 and limit switch 61 act independently so that solenoid 58 is deenergized whenever either mechanism generates an output signal. The signal that turns off solenoid 58 also begins a timing interval. At the end of this timing interval, solenoid 59 is energized to shift valve 54 opposite to the direction that it is shifted by solenoid 58. This action of solenoid 59 shifts valve 54 such that fluid is prevented from flowing out of cylinder 41. Accordingly, springs 37 are unable to raise ram 40 fully upwardly. The distance that the ram is raised depends on the length of the preset time interval between the deenergization of solenoid 58 and the energization of solenoid 59. Since the time interval is adjustable, the length of the stroke of the ram is controllable such that its distance of travel can be set at the minimum required, thereby allowing the ram to operate at maximum speed. In addition, the use of springs 37 to raise the ram permits a faster operating speed than is achieved with other methods of returning the ram.

Figure 12:
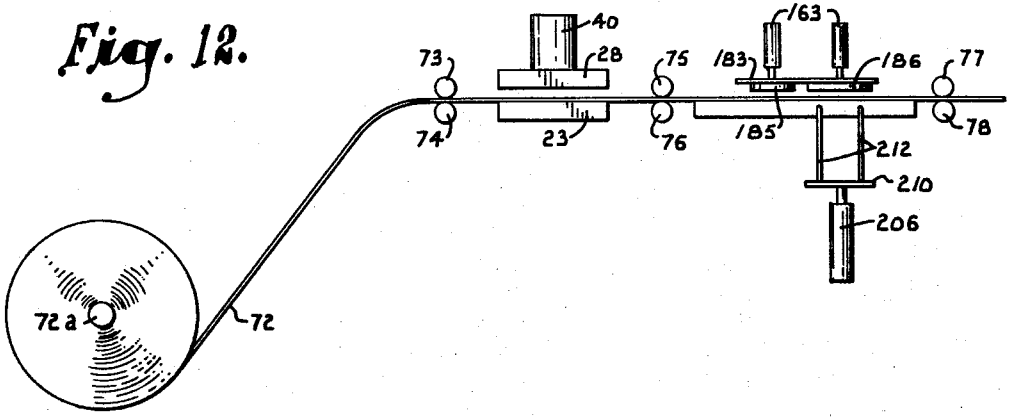
FIG. 12 is a schematic view illustrating the manner in which gasket material is fed through the cutting dies and knock out cylinders of the machine by advance rollers.

A feed system is provided to advance the gasket material through the machine in the required periodic manner. FIG. 12 illustrates schematically three sets of rollers which comprise the feed system and also a long strip of gasket material 72 which may be wound on a spool 72*a*. The first pair of rollers 73 and 74 are located behind the cutting press, the second pair of rollers 75 and 76 are located forwardly of the press, and the third pair 77 and 78 are mounted on the forward end of the machine.

With particular reference to FIGS. 2 and 3, rollers 73 and 74 are supported for rotation at their opposite ends on mounting brackets 79 which are secured to the opposite ends of a support plate 80. Plate 80 is in turn mounted on the frame of the machine in a manner that will be described later. Referring additionally to FIG. 1, the second pair of rollers 75 and 76 are supported on mounting brackets 81 which are secured to a support plate 82 that is similarly mounted on the frame.

The third pair of rollers 77 and 78 are located on the forward end of a frame structure that extends forwardly of the cutting press. This frame structure includes a thin plate 83 (FIG. 1) that is bolted against plate 15 by bolts 84. A vertical plate 85 which is cut away in its central portion extends upwardly from plate 83 to substantially the level of the upper surface of block 17. Parallel angle members 86 extend forwardly from the top of plate 85 at the opposite sides thereof. A short side panel 87 extends between plate 83 and one of the angle members 84, while a longer side panel 88 extends below the other angle member 86 the entire length thereof. An end plate 89 is secured to extend between the forward ends of angle members 86.

Figure 7:
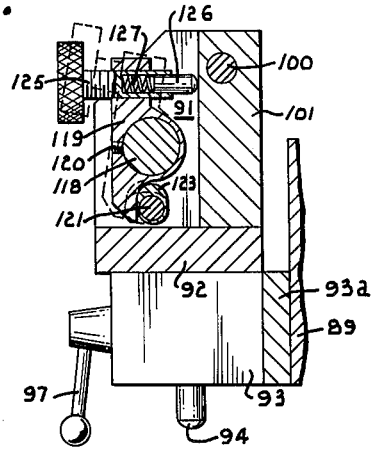
FIG. 7 is an enlarged, fragmentary sectional view taken generally along line 7—7 of FIG. 5 in the direction of the arrows.
Figure 8:
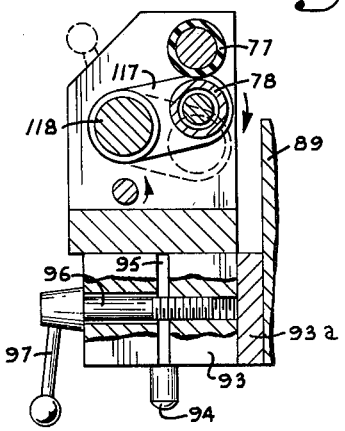
FIG. 8 is a fragmentary cross-sectional view on an enlarged scale taken generally along line 8—8 of FIG. 5 in the direction of the arrows.

FIGS. 5, 7 and 8 illustrate the structure and mounting means of the end rollers 77 and 78, and it is to be understood that the other two roller units are constructed and mounted in a similar manner. Rollers 77 and 78 extend between mounting brackets 91 which are secured near the opposite ends of a support plate 92. Plate 92 is normally supported on top of a pair of blocks 93 that are mounted to a plate 93*a* that is secured to the end plate 89. Vertical pins 94 extend below plate 92 and are received in bores that are formed through blocks 93. A split area 95 (FIG. 8) extends from the bore of each block 93 to the surface thereof, and a threaded rod 96 is threaded between the split sections of each block in order to tighten the blocks on pins 94. A handle 97 is provided on the end of each rod 96 to facilitate the turning of the rods. Loosening of handles 97 releases pins 94 and permits the entire roller unit to be lifted off of blocks 93 and removed from the machine. The height at which the roller assembly is disposed may be adjusted by means of a thumb screw 98 (FIG. 5) which is threaded into a block 98*a* that is secured to plate 89. With handles 97 loosened, screw 98 may be turned to raise plate 92 and the rollers.

The upper roller 77 is a driven roller, while the lower roller 78 is urged toward roller 77 in order to pinch the gasket material between the two rollers. Roller 77 comprises a sleeve which is coated with a cast urethane material of approximately 40–45 durometer in order to increase its driving traction. Roller 77 is fit on a somewhat smaller sleeve member 99 which is in turn fit on a shaft 100. Shaft 100 extends through brackets 91, through a block 101 that is secured on plate 92 at a location adjacent to one of the brackets 91, and through another bracket 102 located adjacent to block 101. One end of shaft 100 carries a bevel gear 103 (FIG. 5) which is located within a gear box 104. Gear 103 mates with another bevel gear 105 that is carried on the top end of a vertical shaft 106. A hexagonal fitting 107 is secured on shaft 106 and is received within a hexagonal sleeve 108. Flexible couplings 109 couple sleeve 108 with another sleeve 110 and with a shaft 111 on which a sprocket 112 is carried. A chain 113 fits around sprocket 112 to drive shaft 111 and ultimately roller 77 through the bevel gearing arrangement. The lower end of shaft 111 is rotatably supported in a bearing 114. A guard 115 (FIG. 1) encloses sprocket 112. Shaft 106 and the hexagonal fitting 107 may be lifted out of sleeve 108 when the roller assembly is removed, and the flexible couplings 109 facilitate installation of the roller assembly and also compensate for any misalignment.

With particular reference to FIG. 8, the lower roller 78 is rotatively supported at its opposite ends by brackets 117 which also receive a shaft 118 that is keyed to the brackets. Shaft 118 is parallel to roller 78 at a location forwardly thereof, and the opposite ends of the shaft are supported for rotation on brackets 91. One end of shaft 118 fits through a block 119 to which it is fixed by a set screw 120. An elongate rod 121 located below shaft 118 and parallel thereto is supported on brackets 91 and bracket 102. One end of rod 121 projects beyond one of the brackets 91 and carries a handle 122 by means of which the rod may be rotated about its axis. An eccentrically mounted cam 123 (FIG. 7) rotates with rod 121 and acts against a curved surface of block 119. Turning of handle 122 causes cam 123 to pivot block 119 by camming action to the position shown in broken lines in FIG. 7, and this in turn pivots shaft 118 about its axis. Brackets 117 are pivoted with shaft 118 to move roller 78 downwardly or away from roller 77 to the broken line position shown in FIG. 8.

A thumb screw 125 is threaded through the upper portion of block 119. A plunger 126 projects out of a recessed area of thumb screw 125, and a compression spring 127 is fit in the recess of the screw behind plunger 126. Spring 127 continuously urges plunger 126 outwardly or against block 101 and thus biases roller 78 toward roller 77. The extent to which screw 125 is threaded into block 119 controls the compression of spring 127 and thus determines the force with which roller 78 is urged against roller 77.

As previously indicated, the other two roller units are constructed and mounted in essentially the same manner. Referring to FIGS. 2 and 3, the roller assembly located on the rearward portion of the machine includes a block 119*a* that corresponds to the block 119 previously described. Block 119*a* is pivoted by a cam (not shown) in order to separate the lower roller 74 from the driven upper roller 75 when a handle 128 is turned. In addition to the manual separation of rollers 73 and 74 provided by the handle 128, a pneumatic cylinder 129 acts against block 119*a* to separate the rollers. The piston rod of cylinder 129 bears upwardly against a projection 130 of block 119*a* so that extension of the cylinder pivots the block in a manner to separate rollers 73 and 74.

In cases where a series of relatively short strips of gasket material are to be fed through the machine, cylinder 129 is activated to extend when the trailing edge of each strip of material has passed through rollers 73 and 74. This extension of the cylinder separates the rollers for insertion of the next strip of gasket material while the other two sets of rollers continue to advance the strips that have already passed rollers 73 and 74. In this manner, cylinder 129 permits even short strips of gasket material to be fed through the machine with very little loss of time involved in inserting successive strips.

Rollers 73 and 75 are driven in the same manner described in connection with roller 77. The shafts on which rollers 73 and 75 are carried are driven by bevel gears (not shown) which are driven by shafts (also not shown) that carry respective hexagonal fittings 132 and 133 (FIG. 3). Hexagonal sleeves 134 and 135 closely receive fittings 132 and 133. Sleeves 134 and 135 are coupled to shafts 136 and 137, respectively, by sets of flexible couplings 138 and 139. Shaft 136 carries a sprocket 140 on its lower end which receives a chain 141 that also fits around a sprocket 142 carried on the lower end of shaft 137. Shaft 136 carries another sprocket 143 above sprocket 140. Sprocket 143 receives the chain 113 that drives sprocket 112. Shafts 136 and 137 are supported in respective bearings 144 and 145 (FIG. 3).

The chain and sprocket drive operates the feed rollers and is powered by a motor 147. The motor is supported on mounts 148 which are secured to the underside of plate 15. As shown in FIG. 4, an output shaft 149 of the motor carries a sprocket 150 that drives chain 141. Respective idler sprockets 151 and 152 which are mounted on adjustable arms 153 and 154 engage chains 113 and 141 to provide a means for adjusting the chain tension. Motor 147 is a permanent magnet stepping motor, the operation of which is governed by controls that will be described in more detail hereinafter.

A horizontal platform 156 is located behind the cutting press to receive the gasket material before it reaches the first set of rollers 73 and 74. Platform 156 is bent downwardly and forwardly at its rearward portion and is secured to the frame of the machine by a pair of screws 157. The level of the platform is substantially between rollers 73 and 74. A pair of parallel angles 158 are mounted on platform 156 to serve as guides that maintain the gasket material centered on the platform and oriented properly for feeding through the machine. The spacing between angles 158 is adjustable in order to accommodate material of various widths.

Figure 9:
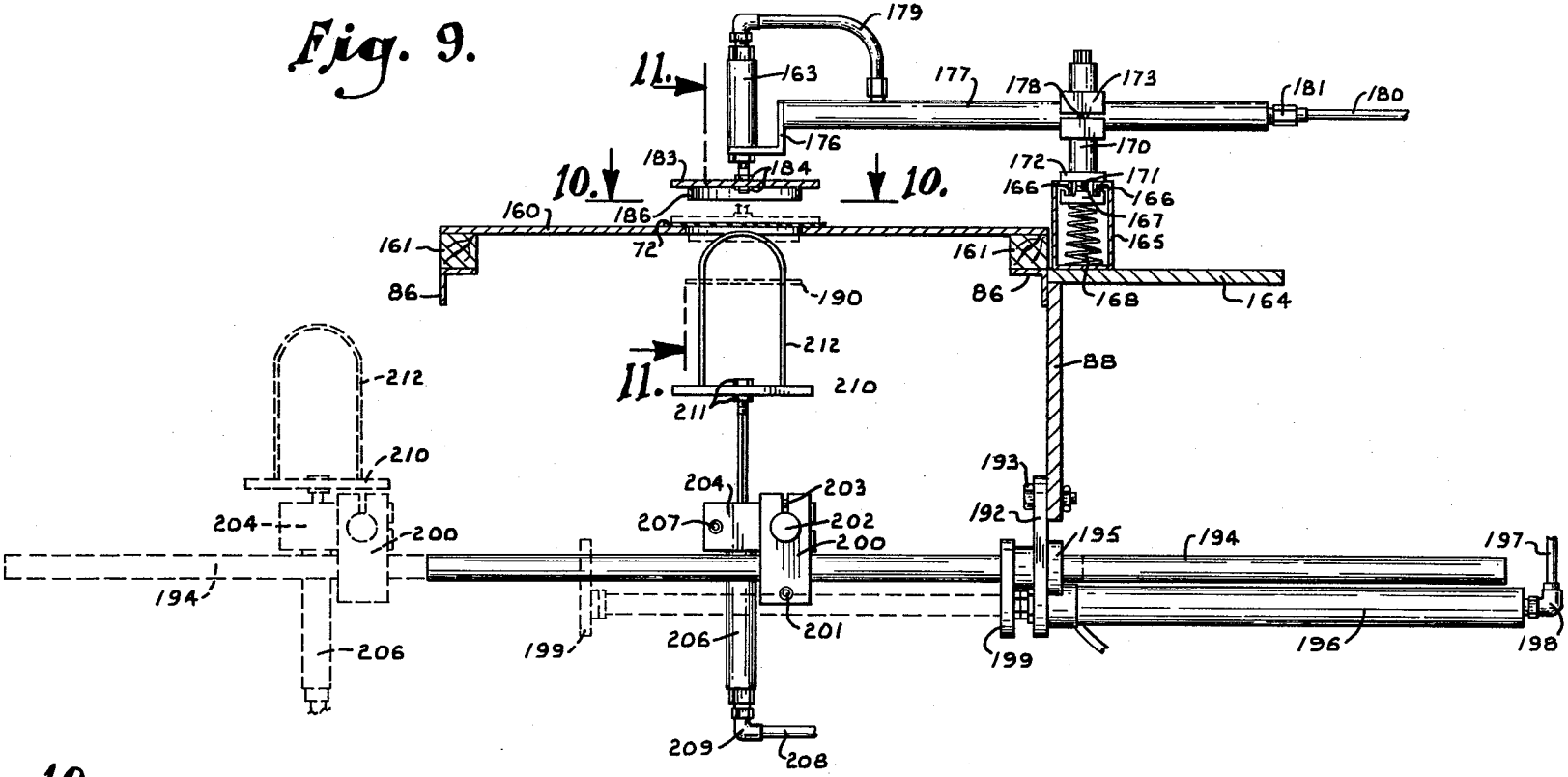
FIG. 9 is an enlarged, end elevational view of the stacking mechanism taken generally along line 9—9 of FIG. 3 in the direction of the arrows.

With reference to FIG. 9, a removable table 160 is mounted on the forward portion of the machine to receive the gasket material between the two forward sets of rollers. Table 160 is supported horizontally on bars 161 which lie along the angle members 86. Table 160 is located at substantially the level of the feed rollers.

One or more pneumatic cylinders 163 knock the gaskets and scrap material out of strip 72 as it travels along table 160. A horizontal plate 164 (FIG. 9) extends outwardly from the top edge of side panel 88, and a hollow box 165 is mounted on top of plate 164. Box 165 extends the entire length of plate 164 and has an elongate slot formed in its top. Internal flanges 166 are turned downwardly from the edges of the slot. A pair of small grooved plates 167 are located within box 165 against the flanges 116 thereof. Each plate 167 is provided with spaced grooves in which flanges 166 are received in order to permit the plate to be slid longitudinally within the box. Compression springs 168 which are contained within box 165 act upwardly against plates 167 to maintain them against flanges 166.

A pair of vertical sleeves 170 are fit over respective screws 171 which are threaded into plates 167 at their lower ends. A square nut 172 is threaded onto each screw 171 and is engaged between the top of box 165 and the bottom of sleeve 170. A pair of split blocks 173 have bores in which the respective sleeves 170 are received. The blocks 173 may be locked in place on the sleeves by tightening screws 174 which are threaded between the split sections of the blocks.

The pneumatic cylinders 163 are mounted on brackets 176 which are secured to the ends of respective support rods 177. Rods 177 are hollow tubes that are oriented horizontally and fit through bores in the respective blocks 173. Rods 177 are thus able to slide relative to blocks 173 and may be locked in place by means of screws 178 that are threaded between the split sections of the blocks. Air lines 179 extend from rods 177 to the top ends of cylinders 163. Inlet air lines 180 are equipped with quick connect couplings 181 that may be coupled to the end of rod 177 to supply air thereto for operating the cylinders.

Figure 11:
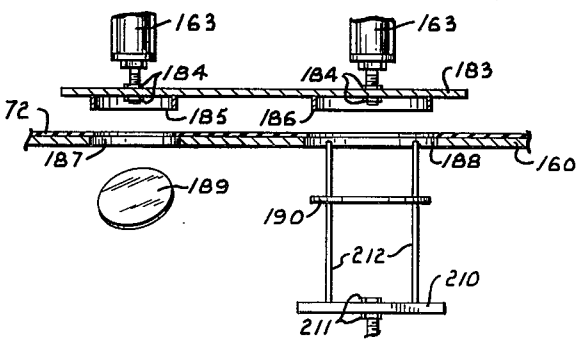
FIG. 11 is a fragmentary sectional view taken generally along line 11—11 of FIG. 9 in the direction of the arrows.
Figure 10:
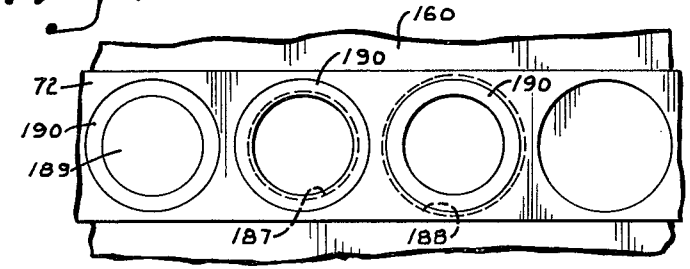
FIG. 10 is a fragmentary plan view taken generally along line 11—11 of FIG. 9 in the direction of the arrows.

Cylinders 163 are adjustable as to their position relative to the length and width of table 160, and also as to their height thereabove. Various knockout dies may be mounted on the cylinders to knock out the gaskets and scrap pieces, with the particular die employed depending on the size and shape of the gaskets that are cut in the cutting press. FIGS. 9 and 11 illustrate a knockout unit that includes a horizontal plate 183 that is secured to the rod of each cylinder 163 by nuts 184. A pair of circular dies 185 and 186 are mounted to the underside of plate 183, with die 186 being larger than die 185 and located downstream thereof. Table 160 is provided with circular cutouts or openings 187 and 188 at locations directly below dies 185 and 186, respectively. Openings 187 and 188 are slightly larger than the central slugs 189 (FIG. 11) and the gaskets 190 which are able to fall through the openings after being knocked out of the strip 72.

The gaskets that are knocked out of strip 72 are arranged in stacks in order to facilitate their further handling. With reference to FIG. 9, a mounting plate 192 is secured to the lower portion of side panel 88 by bolts 193. A pair of horizontal rods 194 are supported in bearings 195 which allow the rods *t* slide axially relative to plate 192. A pneumatic cylinder 196 is mounted to plate 192 in a horizontal position, and an air line 197 having a quick connect coupling 198 supplies air to the cylinder. The piston rod of cylinder 196 is secured to a plate 199 which is also fixed to rods 194 so that extension and retraction of the cylinder extends and retracts the rods.

A split block 200 is mounted on the outer end portion of each rod 194 and is adjustable along the length thereof. A screw 201 is threaded between the split sections of each block 200 to lock it in place on its rod 194. A short horizontal rod 202 extends through a bore in each block 200 and is oriented at a right angle to rod 194. Each rod 202 may be locked to block 200 by a screw 203. Another split block 204 is received on the opposite end portion of each rod 202 and may be locked in place thereon by a screw (not shown). A pair of vertically oriented pneumatic cylinders 206 are received in bores that are formed through the respective blocks 204. Each cylinder 206 is adjustable as to its position relative to block 204 and may be locked in place by a screw 207. An air line 208 having a quick connect coupling 209 supplies air to cylinders 206.

Cylinders 206 support and accurately position various rack assemblies that receive the gaskets, with the particular rack employed depending on the size and shape of the gaskets. FIGS. 9 and 11 illustrate a rack assembly that includes a horizontal plate 210 which is secured to the rod of cylinder 206 by a pair of nuts 211. A pair of upstanding wire elements 212 extend upwardly from plate 210. Wires 212 are each in the general shape of an inverted U and are spaced apart so that circular gaskets 190 will fit over them and become stacked on plate 210.

A control box 214 (FIGS. 1 and 2) is secured to one side of the machine frame, and a control panel 215 is located on top of box 214. Various pushbuttons 216 which control the operation of the machine are located on the control panel 215. Right and left palm buttons 217 are mounted on top of plate 15 on opposite sides of the cutting press.

Figure 14:
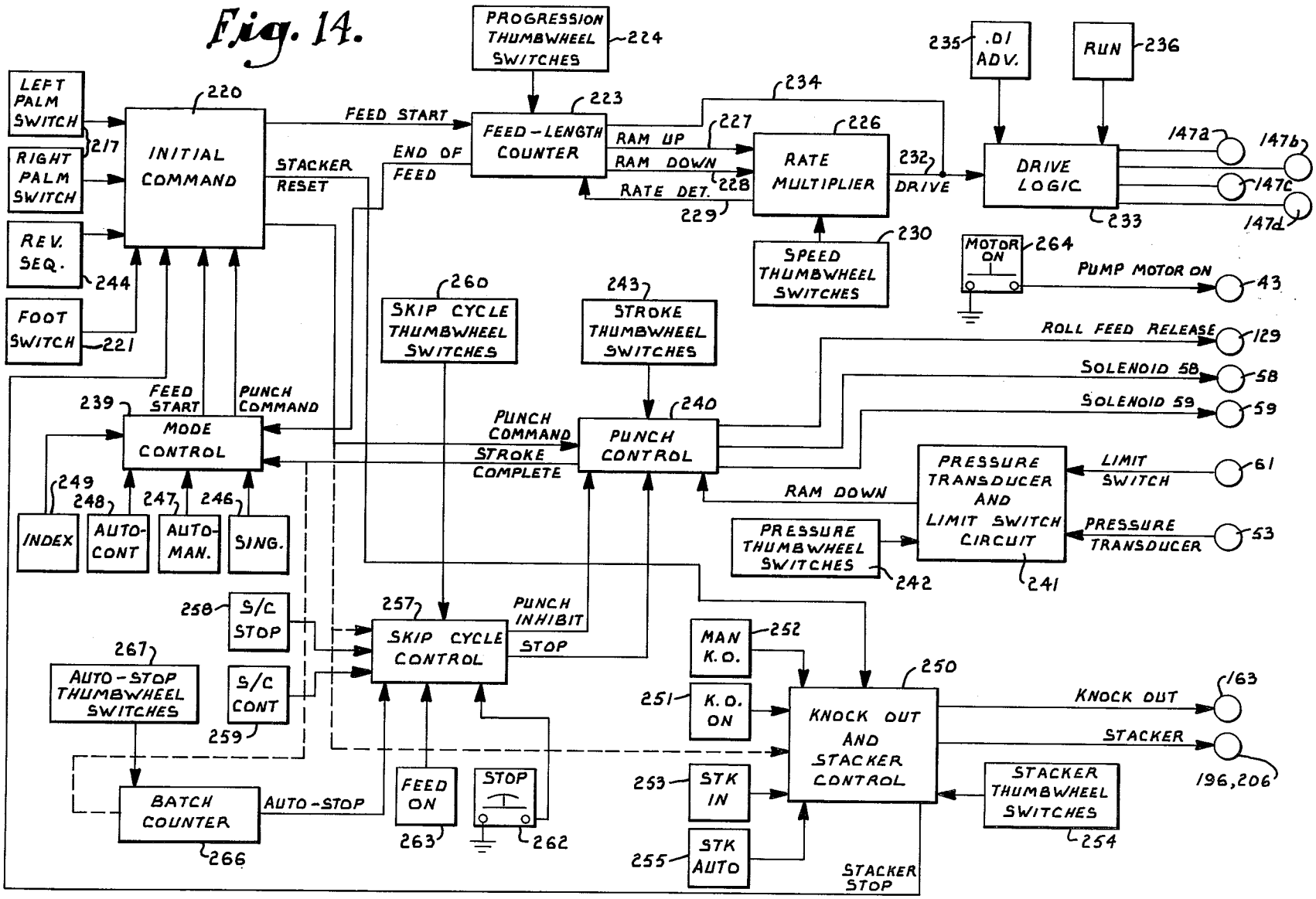
FIG. 14 is a block diagram of the control unit which controls the operation of the machine.

FIG. 14 illustrates the electronic control unit which controls the operation of the machine. The control unit provides command inputs which activate solenoids 58 and 59, the motor 43 which drives pump 44, the roll feed release cylinder 129, the stepping motor 147, the knockout cylinders 163, and the stacker cylinders 196 and 206. The control unit supplies commands to these devices at the proper time and in accordance with conditions that are set forth by the various manual switches that will be described.

The dual palm switches 217 activate an initial command circuit 220, as does a foot switch 221. The depression of either one of the dual palm switches 217 initiates a fixed time delay of approximately 0.5 seconds during which cycling of the feed unit will not begin unless the other palm switch 217 has been depressed. The foot switch 221 functions in essentially the same manner as an alternative to the palm switches 217.

The initial command circuit 220 has a feed start output signal which is applied to a feed length counter circuit 223 which comprises part of the feeding system. The feed length counter circuit 223 has a progression switch 224 which establishes the distance that the gasket material is advanced for each feed cycle. Switch 224 is calibrated in units of 0.01 inch so that a setting of 100 advances the gasket material a distance of 1 inch. The feed length counter 223 signals a rate multiplier circuit 226 via a ramp up line 227 and a ramp down line 228. A rate detect signal is generated by the rate multiplier 226 and is applied to circuit 223 via line 229 when a predetermined maximum frequency of the pulses generated by circuit 226 is reached. This predetermined frequency is set by a speed thumb wheel switch 230. The primary function of switch 230 is to allow the setting of a slow acceleration-deceleration rate when feeding heavy material and a fast rate when feeding light material. The rate multiplier circuit 226 is a pulse generator that provides a drive signal via line 232 to a drive logic circuit 233. The drive signal is also fed back to the feed length counter circuit 223 by a feedback line 234.

The drive logic circuit 233 generates output signals 147*a*, 147*b*, 147*c* and 147*d* which are fed in sequence to the stepping motor 147. Motor 147 has two windings and these output signals from circuit 233 reverse the direction of current in the motor windings and cause the motor to increment one step for each pulse. Each increment of the stepping motor rotates the output shaft 149 1.8° which in turn advances the driven roller in each roller pair a distance of 0.01 inch. The drive logic circuit has a 0.01 advance switch 235 which advances the feed rollers 0.01 inch when it is depressed. In addition, the drive logic circuit has a run switch 236 which generates a steady string of steps of the motor when it is depressed and held.

When a feed start command is given to the feed length counter circuit 223, a ramp up signal goes to the rate multiplier circuit 226 which begins to generate pulses of increasing frequency. When the rate multiplier reaches a predetermined maximum frequency that is set by switch 230, a rate detect signal via line 229 is applied to the feed length counter 223. The feed length counter subtracts the pulses at the steady high frequency from the total number required (as set by switch 224) and divides the remainder by 2. When this number remains from the total number of steps required, a ramp down signal is fed to the rate multiplier which then begins to decrease the pulse frequency. In this manner, the ramp up and ramp down lines 227 and 228 compensate for the inertia of the motor by increasing and decreasing the frequency. When the total number of steps or pulses generated to the drive logic circuit 233 is reached (and motor 147 has been driven through a cycle to advance the gasket material a preselected distance), the feed length counter 223 generates an end of feed command.

The end of feed command is applied to a mode control circuit 239 which in the normal case generates a punch command signal that is applied to the initial command circuit 220. The punch command signal is then applied from the initial command circuit 220 to a punch control circuit 240. When the punch command is received by circuit 240, a signal is applied to solenoid 58. This signal energizes solenoid 58 which shifts valve 54 in a manner to direct hydraulic fluid to the ram 40 for extension thereof. This forces die 28 downwardly toward die 23 and effects a power stroke which cuts the gasket material.

The end of the power stroke is determined by either the limit switch 61 or the pressure transducer 53, both of which signal a pressure transducer and limit switch circuit 241. Pressure thumb wheel switches 242 set the level at which the pressure transducer 53 deenergizes the hydraulic valve 54, and the thumb wheel switch 65 adjusts the position of the limit switch 61 in the manner indicated previously. A ram down output signal from circuit 241 is applied to circuit 240 which discontinues the signal to solenoid 58. Springs 37 then begin to raise die 28. The ram down signal also begins the previously described timing interval that controls the operation of solenoid 58. The duration of this interval is determined by the setting of stroke thumb wheel switches 243. At the end of this interval, circuit 240 generates a signal to solenoid 59 which thereby shifts valve 54 in a manner to stop the return flow of fluid from ram 40. This causes the ram to stop and therefore limits the extent to which the ram is retracted upwardly.

At the same time that solenoid 59 is signaled to turn on, a stroke complete signal is generated from the punch control circuit 240 and applied to the mode control circuit 239. Circuit 239 then generates a feed start signal which is applied to the initial command circuit 220 and then to the feed length counter circuit 223 in order to begin another feed cycle. In this manner, the control circuit normally effects feeding of the gasket material and then a punch stroke. A reverse sequence switch 244 associated with circuit 220 serves to reverse this sequence so that each cycle starts with a press stroke followed by an index of the feed rollers when switch 244 is activated.

The mode control circuit 239 has a single cycle switch 246 which limits the machine to only one cycle (feedpunch) even when palm buttons 217 or the foot switch 221 are maintained in their depressed condition. A manual continuous or auto manual switch 247 may be activated to cause the machine to cycle continuously as long as both palm buttons 217 or foot switch 221 remain depressed. When switches 217 and 221 are released, the cycling will stop but the motor will continue to run and the ram will be held at the selected stroke. An auto continuous switch 248 may be depressed to initiate cycling when switches 217 or 221 are depressed, the cycling continuing in this case even after switches 217 and 221 are released. A ready switch (not shown) must be depressed before a cycle can be initiated when the auto continuous mode is selected. This ready switch makes the palm switches 217 and the foot switch 221 active for a preselected time interval. An index switch 249 serves to cause indexing of the gasket material one cycle without a punch comand being generated.

A knockout and stacker control circuit 250 controls the operation of the knockout cylinders 163 and the stacker cylinders 199 and 206. With a knockout on switch 251 activated, the punch command signal from circuit 220 is applied to circuit 250 which in turn applies a knockout signal to cylinders 163 in order to effect a stroke of these cylinders for each stroke of ram 40. A manual knockout switch 252 causes a single stroke of knockout cylinders 163 when depressed. A stacker in switch 253 actuates cylinders 199 and 206 and causes the cylinders to maintain the rack assembly in position to receive parts until the press has cycled a predetermined number of times, as set on stacker thumb wheel switches 254. A stacker automatic switch 255 may be depressed to permit the knockout counter to receive a signal from the knockout cylinders. When the number of parts set on switches 254 become stacked on the rack assembly, circuit 250 generates a stacker stop signal which is applied to the initial command circuit 220 to stop the cycling of the machine. Cylinders 199 and 206 then move the rack assembly away from the machine to an accessible position where the stack of parts may be removed. When palm switches 217 or foot switch 221 are then depressed, circuit 220 generates a stacker reset signal which is applied to circuit 250 and which causes cylinders 199 and 206 to position the rack assembly properly to receive additional parts before the machine begins to cycle again.

The remaining controls are useful primarily when a series of relatively short strips of gasket material are to be run through the machine. A skip cycle control circuit 257 receives a signal simultaneously with the punch command signal from circuit 220 when a skip cycle stop switch 258 or a skip cycle continuous switch 259 is activated. Skip cycle thumb wheel switches 260 provide both a punch switch and an index switch. The punch switch may be set to determine the number of parts that will be formed on each strip of material. When this number of parts has been formed by the cutting dies, circuit 257 applies a punch inhibit signal to circuit 240. The punch inhibit signal overrides the punch command signal to circuit 240 in order to prevent further power strokes of ram 40. The punch inhibit signal also causes circuit 240 to generate the stroke complete signal so that the feed system will continue to index the gasket material through the knockout portion of the machine. The setting of the index switch included in thumb wheel switches 260 determines the number of feed cycle through which the material will be indexed and is chosen to permit each strip of material to be advanced completely out of the feed rollers.

After the index sequence (as determined by the setting of index switch 260) is completed, the machine will stop if the skip cycle stop switch 258 has been selected or will begin an additional punch sequence if the skip cycle continuous switch 259 has been selected. If switch 258 has been selected and the machine stops, it may be restarted for another cycle by activating palm switches 217 or foot switch 221. A stop switch 262 serves to stop the cycling of the cutting press when the machine is in the auto continuous mode as determined by switch 248. With switch 262 activated, a stop signal from circuit 257 is applied to circuit 240 to override the punch command signal and thus stop the operation of ram 40. The stroke complete signal continues to be applied to circuit 239 so that the index cycles are not interrupted. A feed on switch 263 serves to actuate the feed control system and inhibits the feed except for the 0.01 advance switch 235 and the run switch 236 associated with circuit 233. Switch 263 must be out when power is initially applied to the machine.

When either the punch inhibit or stop signal is applied to circuit 240, a roll feed release signal is applied to the release cylinder 129. This signal causes cylinder 129 to extend and thus separates rollers 73 and 74 to permit insertion of another strip of gasket material while the preceding strip continues to be fed through the knockout station and out of the machine. A motor on switch 264 controls the pump motor 43 and must be on before pump 44 is able to pump hydraulic fluid for operation of the ram.

A batch counter circuit 266 receives a signal simultaneously with the stroke complete signal from circuit 240 when auto stop thumb wheel switches 267 are activated. Switches 267 may be set at a preselected number of press strokes, and when this number is reached the batch counter circuit 266 generates an auto stop signal which is applied to circuit 257. The stop signal which stops the cutting press is then applied to circuit 240 from circuit 257. A reset switch (not shown) serves to reset all counts to zero.

In operation, the machine forms gaskets and other parts which may be blanked out of the gasket material in the cutting press. In this case, a blanking tool (not shown) will be mounted on cutting die 28, and the parts that are blanked out by the tool will fall through the open lower die 23 and into chute 22 for collection.

The machine is also able to form parts and arrange them in stacks containing a preselected number. Annular gaskets 190 require a steel rule cutting tool (not shown) which has a pair of cutting blades arranged in concentric circles. If the gasket material 72 is in a long strip wound on spool **72*a* and the diameter of each gasket is slightly less than 2 inches, for example, the progression switches 224 will be set at "200" so that motor 147 will advance 200 steps in order to advance the gasket material exactly 2 inches for each feed cycle. In addition, assuming that the gaskets are to be arranged in stacks of 100 parts, the number "100" will be set on switch 254**.

To ready the machine for operation, the auto continuous switch 248 may be activated along with the motor on switch 264. Switches 242 and 243 may be adjusted to adjust the pressure transducer 53, the limit switch 61, and the extent to which the ram is retracted, as previously described. When the ready switch (not shown) is depressed, the machine is ready to begin operation.

With the gasket material inserted in the feed rollers, both palm switches 217 or the foot switch 221 are depressed to begin the initial index of the gasket material which is advanced exactly 2 inches by the feed rollers due to the setting of switch 224. When the material has stopped indexing, the end of feed command to circuit 239 generates a punch command which is applied to circuit 220 and then to circuit 240, causing a power stroke of ram 40. This power stroke causes the cutting tool (not shown) to cut completely through the gasket material in a pair of concentric circles. When the power stroke is completed, the stroke complete signal from circuit 240 is applied to circuit 239 which generates the feed start signal that begins another 2 inch advance of the gasket material prior to the next cutting stroke.

The gasket 190 and center slugs 189 that are cut in the cutting press remain on the strip 72 and are advanced therewith out of the press and along table 160. The gaskets and slugs are advanced with the material in precise 2 inch increments until they are located directly beneath the first knockout die 185. Simultaneously with the power stroke in the cutting press, a signal from circuit 220 to the knockout and stacker control circuit 250 generates a knockout signal which causes a power stroke of cylinder 163. Die 185 is thereby forced against the slug 189 to knock it out of strip 72, through opening 187, and into a scrap receptable or the like (not shown).

After completion of this knockout stroke, the gasket 190 which remains on the strip is indexed another 2 inch increment which brings it directly beneath die 186. The next knockout stroke of cylinders 163 forces die 186 against the gasket and knocks it out of strip 72. The gasket falls through opening 188 and over the wires 212 where it is stacked on plate 210 on top of the preceding gasket.

The machine continues to form and stack the gaskets in this manner until 100 parts are stacked on plate 210, as determined by the setting of switch 254. When 100 parts have been stacked, the stacker stop signal is applied from circuit 250 to circuit 220 in order to stop the machine. The stacker signal from circuit 250 to cylinder 196 and cylinders 206 retracts cylinders 206 and extends cylinder 196, thereby moving plate 210 out from beneath the machine to a position where the operator can easily remove the stack of parts. After removal of the stack, the machine resumes operation when both palm switches 217 or the foot switch 221 is depressed. The stacker reset signal is applied to circuit 250 which causes cylinders 196 and 206 to position the rack assembly properly from receiving an additional stack of gaskets. The feed start signal from circuit 220 then begins further operation of the machine until 100 more parts are formed and stacked on plate 210. The return of ram 40 by springs 37 along with the adjustment of the stroke length to the shortest possible travel by switch 243 and the speed adjustment of the feed system provided by switch 230 allows the machine to run at a rate up to 300 strokes per minute, which is much faster than existing machines are able to run.

If the parts are to be formed from a series of relatively short strips instead of from a long strip of material, the skip cycle control 257 is employed. Switch 260 may be set in accordance with the number of parts that are to be formed from each strip of material. As an example, if each part requires 3.6 inches of material (part length plus scrap between parts) and if each strip is 30 inches long, the punch switch 260 will be set at "8" because 8 full parts will be formed per strip. This avoids the formation of partial parts which tend to jam the cutting dies. After 8 strokes of ram 40 have been completed, the punch inhibit signal is applied from circuit 257 to circuit 240 to stop the ram from further operation, although the strip continues to index through the knockout station and out of the machine since the stroke complete signal continues to be applied to circuit 239. Once the number of indexes set on the index switch 260 has been reached, the machine either stops or begins to feed another strip, depending upon whether switch 258 or 259 is active. The punch inhibit signal to circuit 240 generates the roll feed release signal which extends cylinder 129 to separate rollers 73 and 74 for insertion of another strip of material. In this manner, the machine is able to handle even short strips of gasket material without severely restricting its speed of operation.

It is to be understood that parts having any desired size and shape may be formed by installing appropriate cutting and knockout dies. If the blades of the cutting tool (not shown) are arranged in four concentric circles to form two gaskets for each power stroke of the cutting press, four knockout dies are required to remove the two gaskets and the two scrap pieces from the strip. The first knockout die removes the central slug, the second removes the first or smaller gasket, the third removes the scrap material between the two gaskets, and the fourth die knocks out the larger gasket. In this case, each of the two stacking cylinders 163 carries a separate rack assembly, and the two sets of gaskets are stacked on the separate racks. It is also contemplated that the cutting and knockout dies may be arranged to form two or more parts across the width of the gasket material for each stroke. The rack assembly that is used in this situation is adapted to receive the parts in two or more separate stacks.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. Apparatus for successively forming a plurality of like parts from a strip of relatively thin, stock sheet material, said apparatus comprising:

a frame;

a pair of vertically spaced dies supported on said frame, one of said dies being adapted for reciprocal movement toward and away from the other said die;

a cutting tool mounted on one of said dies, said cutting tool including cutting edges shaped in the outline of said part and adapted to cut the stock material to form said part upon movement of said dies together whereby said part is maintained with said stock material;

power means for periodically forcing said dies together;

knockout means located downstream and remote of said dies and intermittently operable to knock the parts out of said stock material; and a tensioning and feed mechanism on said frame to maintain the stock material in tension across said dies and said knockout means and to periodically and intermittently advance the stock material in preselected length increments, whereby a part cut in said stock material by said cutting tool is advanced from said dies by said feed mechanism to said knockout means where the part is removed from said stock material.

2. Apparatus as set forth in claim 1, including a rack assembly supported beneath said knockout means, said rack assembly being adapted to receive successive parts in a stack thereon.

3. Apparatus as set forth in claim 2, including means for deenergizing said feed mechanism, power means, and knockout means when a preselected number of parts are stacked on said rack assembly.

4. Apparatus as set forth in claim 2, including a power element supporting said rack assembly beneath said knockout means in a stacking position to receive the parts, said power element being operable to move said rack assembly away from said stacking position to a removal position wherein the stack of parts may be removed from the rack assembly.

5. Apparatus as set forth in claim 1, wherein said feed mechanism comprises:

a plurality of pairs of rollers supported on said frame for rotation wherein at least one pair of rollers is located upstream of said dies and at least one pair of rollers is located downstream of said knockout means, said upstream and downstream roller pairs maintaining the stock material therebetween in tension across said dies and said knockout means;

means for biasing each pair of rollers together to tightly engage the stock material therebetween; and drive means for periodically rotating at least one roller in each pair to thereby advance the stock material.

6. Apparatus as set forth in claim 5, including second power means for forcing one pair of rollers apart for insertion of successive strips of stock material therebetween.

7. Apparatus as set forth in claim 5, wherein said drive means includes a stepping motor having a rotary output shaft and drive linkage coupling said output shaft with said one roller of each pair, said motor being operable to periodically drive said output shaft a preselected rotational distance to thereby advance said stock material in said preselected length increments.

8. Apparatus as set forth in claim 1, wherein said power means includes:

an extensible and retractable ram member acting to force one of said dies against the other upon extension; and hydraulic means for periodically extending said ram to effect cutting of said parts.

9. Apparatus as set forth in claim 8, including spring means acting to retract said ram after full extension thereof.

10. Apparatus as set forth in claim 8, including means for adjusting the distance that said ram extends and retracts.

11. Apparatus as set forth in claim 1, wherein said knockout means includes:

a knockout die for knocking the parts out of the stock material; and a power element supporting said knockout die above the stock material for movement toward and away therefrom, said power element being operable to periodically force said knockout die against the stock material to knock out the parts.

12. Apparatus as set forth in claim 11, wherein said feed mechanism includes:

a first pair of feed rollers supported on said frame for rotation at a location upstream of said knockout die;

a second pair of feed rollers supported on said frame for rotation at a location downstream of said knockout die;

means for biasing the rollers in each pair thereof together to tightly grip the stock material and to tension the stock material between said first and second roller pairs; and drive means for periodically rotating at least one roller in each pair to thereby advance the stock material in tension between said first and second roller pairs.

13. Apparatus as set forth in claim 1, wherein said cutting tool is shaped and adapted to effect cuts forming a scrap piece with each part, said knockout means being operable to knock said scrap pieces out of the stock material separately from said parts.

14. Apparatus as set forth in claim 13, wherein said knockout means comprises:

a first knockout die supported above the stock material for movement toward and away therefrom the knock out the scrap pieces;

a second knockout die supported downstream of said first knockout die and above the stock material for movement toward and away therefrom to knock out the parts; and second power means for periodically forcing said first and second knockout dies against the stock material to knock out the parts and scrap pieces.

* * * * *